United States Patent [19]

Mack

[11] Patent Number: 4,621,442

[45] Date of Patent: Nov. 11, 1986

[54] SIMPLIFIED MULTILAYER LABEL

[75] Inventor: Jory B. Mack, Chicago, Ill.

[73] Assignee: Pamco Label Co., Rosemont, Ill.

[21] Appl. No.: 737,528

[22] Filed: May 24, 1985

[51] Int. Cl.[4] ..... G09F 3/02; G09F 3/10

[52] U.S. Cl. ..... 40/2 R; 40/306; 40/310; 40/312; 428/40; 428/43; 428/124; 428/126; 428/130; 283/81

[58] Field of Search ..... 428/40, 43, 124, 126, 428/130; 283/81; 40/2 R, 306, 310, 312

[56] References Cited

U.S. PATENT DOCUMENTS

| | | | |
|---|---|---|---|
| 1,686,354 | 10/1928 | Wallace . | |
| 1,896,834 | 2/1933 | Brown . | |
| 1,924,909 | 8/1933 | Brown | 40/306 |
| 1,949,903 | 3/1934 | Fales . | |
| 1,974,401 | 9/1934 | Miller . | |
| 2,093,985 | 9/1937 | Stansbury . | |
| 2,127,081 | 8/1938 | Brown . | |
| 2,614,349 | 10/1952 | Barnes . | |
| 2,706,865 | 4/1955 | Miller . | |
| 3,638,966 | 2/1972 | Wiersma . | |
| 3,859,958 | 1/1975 | Luscher . | |
| 3,871,639 | 3/1975 | Felix . | |
| 3,993,814 | 11/1976 | Cavender | 283/81 X |
| 3,994,118 | 11/1976 | Felix . | |
| 4,104,816 | 8/1978 | Pingeton . | |
| 4,323,608 | 4/1982 | Denny et al. . | |
| 4,331,327 | 5/1982 | Felix . | |
| 4,334,672 | 6/1982 | Felix . | |
| 4,406,650 | 9/1983 | Felix . | |
| 4,534,582 | 8/1985 | Howard | 283/81 |

FOREIGN PATENT DOCUMENTS

| | | |
|---|---|---|
| 0043179 | 3/1981 | European Pat. Off. . |
| 8100088 | 8/1981 | PCT Int'l Appl. . |
| 1397787 | 10/1972 | United Kingdom . |
| 1596306 | 7/1977 | United Kingdom . |
| 2046717 | 3/1980 | United Kingdom . |
| 2054529 | 6/1980 | United Kingdom . |
| 2073716 | 4/1981 | United Kingdom . |
| 2119345 | 4/1982 | United Kingdom . |

*Primary Examiner*—Alexander S. Thomas
*Attorney, Agent, or Firm*—Garrettson Ellis

[57] ABSTRACT

A multilayer label comprises a front sheet having an adhesive-coated side. A multilayer folded leaflet member adheres to a portion of the adhesive coated side in a position spaced from the ends of the front sheet. A first line of tearing weakness is defined on the front sheet, with the folded leaflet defining a short-folded front layer adhering to the adhesive-coated side. Thus an edge of the front layer lies spaced from parallel edges of the folded leaflet, and some of the adhesive-coated side adheres to the folded layer of the leaflet member adjacent the front layer. Tearing of the first line of weakness exposes the leaflet member, a portion of which may preferably be removable by tearing a second line of weakness formed in the leaflet member.

7 Claims, 4 Drawing Figures

FIG. 1
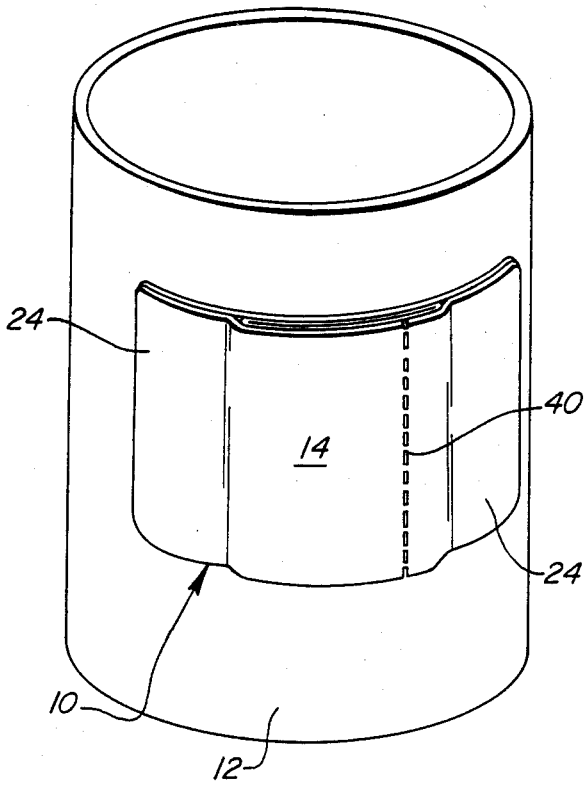
FIG. 2
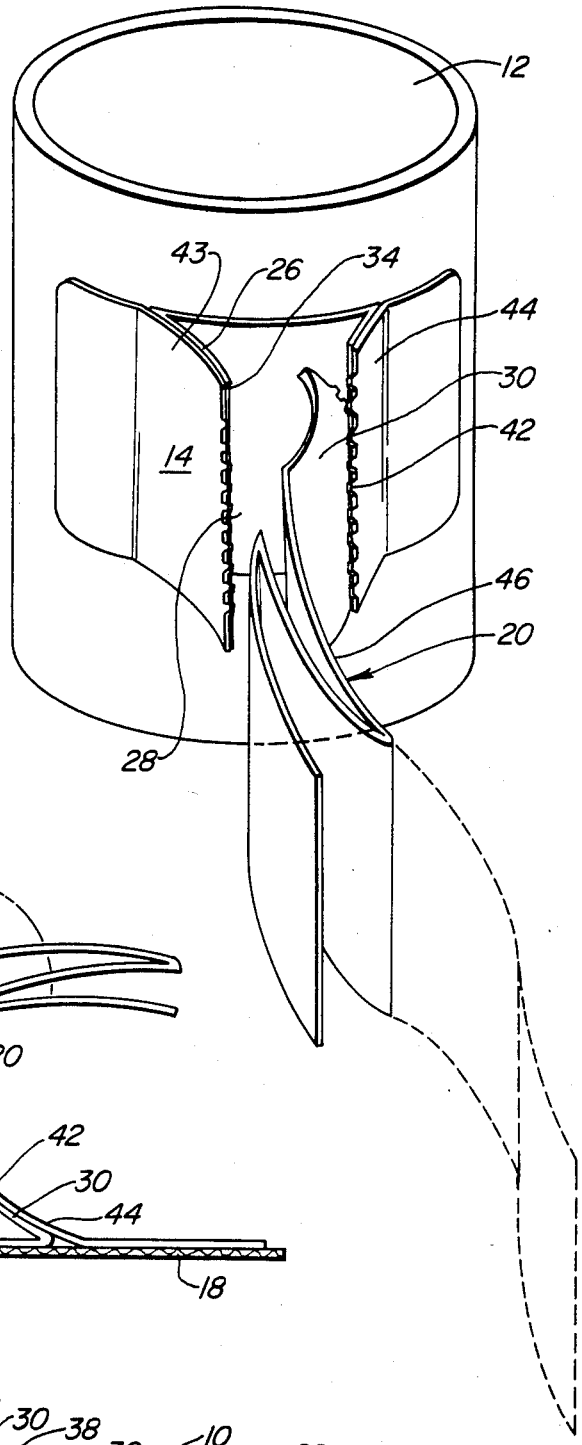
FIG. 4
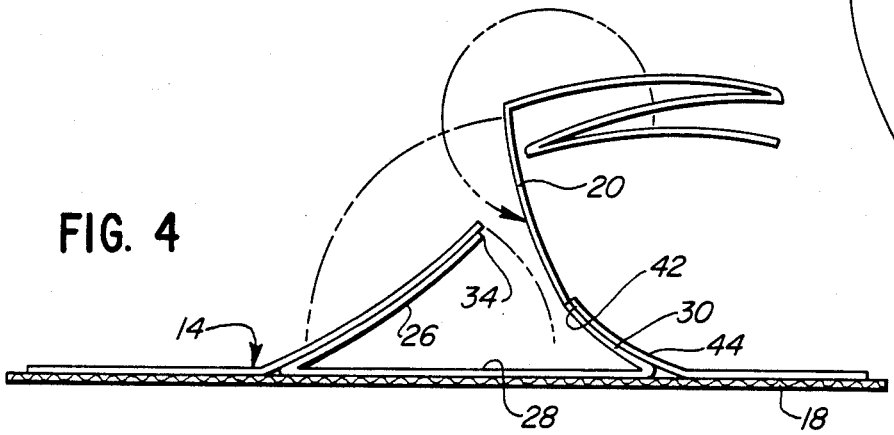
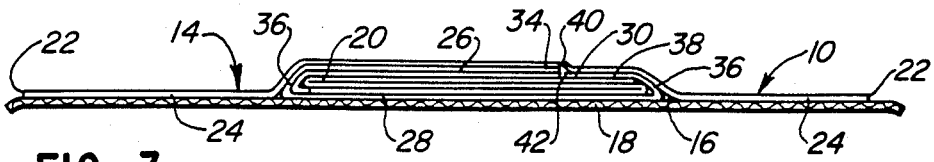
FIG. 3

SIMPLIFIED MULTILAYER LABEL

BACKGROUND OF THE INVENTION

As disclosed in Denny, et al., U.S. Pat. No. 4,323,608, and my copending U.S. aplication Ser. No. 696,773, filed Jan. 31, 1985, labels having multiple layers which may be opened for reading have now become available. Such labels may be used in the packaging of certain chemicals, drugs and the like, where there is a need to provide the user with a substantial amount of information on the label. This may be necessary because of regulations laid down by Government Agencies, and also to provide the user with instructions on how to effectively and safely use the product.

Designs for labels must be very price competitive in order to be commercially successful. In accordance with this invention, a simplified label is provided, being highly susceptible to automated manufacture, with simplified manufacturing steps and reduced cost over labels of the prior art.

DESCRIPTION OF THE INVENTION

In accordance with this invention a multilayer label is provided which comprises a front sheet having an adhesive-coated side. A multilayer leaflet member adheres to a portion of the adhesive-coated side in a position spaced from the ends of the front sheet. A first transverse line of tearing weakness is defined on the front sheet, with the folded leaflet defining a short-folded front layer adhering to the adhesive-coated side.

As the result of this, an edge of the front layer lies spaced from parallel edges of the folded leaflet, to permit some of the adhesive-coated side to adhere to the folded layer of the leaflet member which is adjacent to the front layer.

Preferably, the edge of the front layer described above is in substantial registry with the line of tearing weakness. The folded layer adjacent the front layer may also define a second transverse line of tearing weakness which may preferably also be in registry with the first line of tearing weakness.

The multilayer label is applied to a container or the like with the front sheet positioned outwardly and the folded leaflet being positioned between the front sheet and the container. Since the folded leaflet is spaced from the ends of the front sheet, adhesive coated portions of the front sheet are positioned on both sides of the leaflet and are used to adhere the entire label to its container.

When it is desired to open the label, one may break the first transverse line of tearing weakness which is positioned on the front sheet facing outwardly toward the user. When one has broken this first line of tearing weakness access is obtained to the folded leaflet. One may also sever the second transverse line of tearing weakness to remove a portion of the leaflet when and as desired.

A releasable backing layer may be provided to lie against the adhesive-coated side of the first sheet, and to enclose the leaflet between the front sheet and the releasable backing layer. When it is desired to attach the label to a surface, the backing layer is removed, exposing adhesive portions on opposed sides of the leaflet member, which is attached to the front sheet at a central area of its adhesive layer. The multilayer label of this invention exhibits improvement in that it is capable of manufacture in an automated manner, with the front sheet being a severed portion of a continuous web to which individual leaflet members may be added by conventional leaflet application apparatus, with the lines of tearing weakness being formed at an appropriate time in the process. The resulting label of this invention is, for this and other reasons, highly cost effective.

DESCRIPTION OF THE DRAWINGS

In the drawings,

FIG. 1 is a perspective view of the label of this invention shown in attached relation to a container.

FIG. 2 is a perspective view of the label of FIG. 1 shown in opened condition.

FIG. 3 is a longitudinal sectional view of the label of FIG. 1, shown prior to its application to a container.

FIG. 4 is a longitudinal sectional view of the label of FIG. 3 shown in opened condition.

DESCRIPTION OF SPECIFIC EMBODIMENTS

Referring to the drawings, multilayered label 10 is shown in FIGS. 1 and 2 to be attached to a container 12. As shown in FIG. 3, label 10 comorises a front sheet 14 having an adhesive coated side 16 which is covered by releasable backing layer 18. Paper plastic, or metalized foil web having one adhesive side carrying releasable backing is commercially available in various forms, and usable herein. Any desired form of adhesive may be used.

A multilayer folded leaflet 20 adheres to a central portion of adhesive coated side 16, with leaflet 20 being spaced from the ends 22 of front sheet 14, so that portions 24 of adhesive side 16 are available on opposed sides of leaflet 20 for adhesion to container 12, for example, upon removal of backing sheet 18.

Leaflet 20 may constitute a strip of paper which is folded into a plurality of layers including front sheet 26, back sheet 28, and folded sheet 30, which lies adjacent to front sheet 26. Other folded layers such as layer 32 may be included as may be desired.

In manufacture of the label of this invention, folded leaflet 20 may be placed on adhesive coated side 16 of front sheet 14, causing adherence of leaflet 20 thereto.

It can be seen that front layer 26 of leaflet 20 is short-folded so that edge 34 of front layer 26 lies spaced from the parallel edges 36 of folded leaflet 20. Because of this, a portion 38 of adhesive coated side 16 adheres to a portion of adjacent folded layer 30 which is not overlaid by front layer 26.

First tear line 40 is formed in front sheet 14 by perforation or the like, typically after the adhesion of leaflet 20 to front sheet 14. Second tear line 42 may be formed in leaflet 20 prior to folding of the leaflet, with tear line 42 being preferably parallel to and typically in substantial registry with first tear line 40. Edge 34 of front layer 26 is also positioned adjacent tear line 40, as shown.

Accordingly, in the specific embodiment shown, the user may take a label in accordance with FIG. 3 and remove it from backing layer 18, which may be part of a continuous roll which carries many labels 10. The exposed adhesive layers of end portions 24 may then be used to apply the label to a container or other surface as shown in FIG. 1. The outside face of label 10 may have appropriate printing on it to indicate the contents of the container or the like.

Alternatively, the label of this invention may be provided without a backing layer 18 for direct application to containers or the like on a mass production basis. In this instance, end product multi-layered labels could be individually sheeted and supplied for application in shrink wrapped stacks rather than in continuous roll form.

Leaflet 20 carries added printed information. For example, it may be equivalent to a package insert for drugs containing the necessary and often voluminous information required by the Food and Drug Administration. When it is desired to gain access to the leaflet, the user tears line 40 to sever first sheet 14 as shown in FIGS. 2 and 4. As the major portion 43 of front sheet 14 opens, it carries front layer 26 with it, with edge 34 swinging away from the remaining portion 44 of front sheet 14. Leaflet 20 may then be unfolded as shown.

If desired, a portion 46 may be separated by severing along second tear line 42 for removal and further study from the remaining portion of leaflet 20, which remaining portion remains in adhering relation to front sheet 14, the remaining portion left behind constituting front layer 26, a portion of adjacent layer 30 (since adjacent layer 30 is torn into two pieces along second tear line 42), and back layer 28 which connects layers 26, 20. Leaflet 20 is initially in a parallel type fold as shown in FIG. 3, although other fold arrangements may be used. The outwardly facing portion of inner layer 28 may also carry printed indicia identifying the contents of the container 12.

By this invention a cost effective, multilayer label is provided which can be manufactured with improved cost saving from a single front sheet which encloses a folded leaflet, and which holds the leaflet against the surface to which the label is adhered. Thus the leaflet is well protected, yet the label can be easily opened for extraction of the leaflet. Because of the susceptibility of the label of this invention to automated manufacture, significant reductions in manufacturing cost can be achieved.

The above has been offered for illustrative purposes only, and is not intended to limit the scope of the invention of this application, which is as defined in the claims below.

That which is claimed is:

1. A multilayer label which comprises:

a front sheet having an adhesive-coated side, a multilayer folded leaflet member adhering to a portion of said adhesive-coated side spaced from the ends of such front sheet; a first transverse line of tearing weakness defined on said front sheet over said folded leaflet member, said folded leaflet defining a short-folded front layer adhering to said adhesive-coated side, whereby an edge of said front layer lies spaced from parallel edges of said folded leaflet and some of said adhesive-coated side adheres to the folded layer of the leaflet member adjacent to said front layer.

2. The label of claim 1 in which said edge of the front layer is in substantial registry with the line of tearing weakness.

3. The label of claim 1 in which said folded leaflet member adjacent the front layer defines a second transverse line of tearing weakness, said leaflet being folded so that tearing of the second line of weakness causes separation of a substantial portion of the leaflet member from the front sheet.

4. The label of claim 1 in which a releasable backing layer adheres to portion of said adhesive coated side spaced from said folded leaflet and lies against said folded leaflet, whereby said leaflet is enclosed between the front sheet and the releasable backing layer.

5. A multilayer label which comprises:

a front sheet having an adhesive-coated side; a multilayer folded leaflet member adhering to a portion of said adhesive-coated side spaced from the ends of said front sheet; a first transverse line of tearing weakness defined and on said front sheet over said folded leaflet member, said folded leaflet defining a shortfolded front layer adhering to said adhesive-coated side, whereby an edge of said front layer lies spaced from parallel edges of folded leaflet and some of said adhesive coated side adheres to the folded layer of the leaflet member adjacent said front layer, said folded layer adjacent the front layer defining a second transverse line of tearing weakness, said leaflet being folded so that tearing of the second line of weakness causes separation of a substantial portion of the leaflet member from the front sheet; and a releasable backing layer adhering to portion of said adhesive coated sides spaced from said folded leaflet, said releasable backing layer lying against said folded leaflet whereby said leaflet is enclosed between the front sheet and the releasable backing layer.

6. The label of claim 5 in which the edge of the front layer which is spaced from parallel edges of the folded leaflet is in substantial registry with the first line of tearing weakness.

7. The label of claim 6 in which the second line of tearing weakness is in substantial registry with the first line of tearing weakness.

* * * * *